US006435185B1

(12) United States Patent
Schimpl

(10) Patent No.: US 6,435,185 B1
(45) Date of Patent: Aug. 20, 2002

(54) TRAVELERS' COMFORT—WEARABLE ARM SUPPORT

(76) Inventor: Marie Elizabeth Schimpl, 6856 Bryden Road, Vernon (CA), V1B 3T3

( * ) Notice: Subject to any disclaimer, the term of this patent is extended or adjusted under 35 U.S.C. 154(b) by 0 days.

(21) Appl. No.: 09/802,880

(22) Filed: Mar. 12, 2001

Related U.S. Application Data

(60) Provisional application No. 60/188,628, filed on Mar. 13, 2000.

(51) Int. Cl.[7] ..... A61G 15/00

(52) U.S. Cl. ..... 128/845; 602/4

(58) Field of Search ..... 128/845, 846, 128/869, 877, 878, 879; 602/4, 5, 20

(56) References Cited

U.S. PATENT DOCUMENTS

| | | | | | |
|---|---|---|---|---|---|
| 1,266,688 | A | * | 5/1918 | Kassner | 602/4 |
| 1,621,323 | A | * | 3/1927 | Horn | 602/4 |
| 4,526,164 | A | * | 7/1985 | Bihl | 602/4 |
| 6,030,354 | A | * | 2/2000 | Lakusiewicz | 602/60 |

* cited by examiner

*Primary Examiner*—Michael A. Brown
(74) *Attorney, Agent, or Firm*—Robert Halper

(57) ABSTRACT

An arm support of flexible, knitted fabric that includes a body of material covering the shoulders and both arms with the body extending around the upper back having upper arcuate portions secured by patches of press fasteners such as "VELCRO". The edges of the body are reenforced with strips of rigid binding around the front and circumferential length around the shoulder. In the rear the flexible binding butts on to the rigid binding strip below the wearer's underarms providing latitude in movement. Optionally a blanket can be attached to the body in a choice of locations.

7 Claims, 1 Drawing Sheet

TRAVELERS' COMFORT— WEARABLE ARM SUPPORT

This application replaces the Provisional Application No. 60/188,628 of Marie Elizabeth Schimpl titled Arm Support, filed on Mar. 13, 2000.

FIELD OF INVENTION

This invention pertains to wearable, portable arm supports, particularly useful while traveling long distances, or for people undergoing medical treatment who must sit for extended periods of time.

BACKGROUND OF THE INVENTION

The art teaches that there are a number of restraint devices for supporting arms. Additionally the art teaches means for attachment of other apparel such as pants, skirts, etc. Various type fasteners are also known as is the use of padding and flexible fabric. Exemplary of the known patents are as follows:

U.S. Pat. No. 81,842 is a shoulder brace with suspender. Kid straps are attached to the waistband. The kid sraps are provided with button holes for attachment to the buttons on a skirt or pants.

U.S. Pat. No. 1,048,098 shows an adjustable chain for binding and supporting both arms.

U.S. Pat. No. 1,157,341 illustrates a shawl of knitted fabric adapted to snuggly engage the arms, shoulders, and a portion of the back.

U.S. Pat. No. 2,150,069 illustrates berry picking sleeves adapted to be drawn over the arms and secured inplace by a strip of canvas extending across the back with elastic straps secured to the corners of the canvas and the upper ends of the sleeves. Movements of the wearer are thus not impeded and at the same time the sleeves will snugly fit the arms of various persons with equal comfort.

U.S. Pat. No. 2,295,806 teaches a restraining device for anaesthesia and surgery wherein a belt encircles both arms and wrist straps connected to the belt are connected to another belt that restrains the knees.

U.S. Pat. No. 2,560,243 shows a sling for supporting two arms where there is no neck strain. The sling is a T-sheet of flexible material having laterally extended arms as seen in FIG. 2, that embrace the waist of the wearer. There are also fasteners to secure the arms. The stem portion of the sheet is slotted to fit around a person's neck. There are a pair of forked portions whose upper parts rest on the shoulders and the lower parts terminate in the aforesaid sling which is adjustable by means of buckled straps U.S. Pat. No. 4,877,038 is a hand and arm restraint for hospitalized patients. A pouch receives the hands and arms of the patient through arm openings which are adjustable. Adjusting straps allow securing the pouch to a bed frame and to adjust the position of the pouch so that the patient can comfortably fold his arms.

U.S. Pat. No. 5,086,762 depicts a typing brace apparatus wherein there is an elbow strap with padding and a wrist strap. The straps depend from a rigid yoke that embraces the shoulder. The brace enables typing comfort for a person sitting at a computer and also relieves stress.

The device of this invention is for the most part functionally different as well as structurally different. It is not a restraint device but one that affords comfort. Unlike most of the prior art it is intended to support both arms with a unitary structure which is readily removable.

It therefore is an object of this invention to provide a support for both arms simultaneously.

It is also an object of this invention to provide a support which is easy to install and remove.

It is a further an object of this invention to provide an arm support which is especially useful when travelling or sitting for long periods of time.

SUMMARY OF THE INVENTION

The arm support in question is made of a flexible knit fabric having a frontal body divided into frontal edges and rear edges. The front is approximately of square shape with shoulder and elbow darts and a horizontal envelope so that when the elbows are bent the lower portions of the arms and hands rest comfortably within the envelope. The upper part of the body extends over the shoulders and fastens around the top portions of the wearer's back Underlying the front edges is a binding of rigid non-flexible fabric which also embraces the arms. The body extends around the rear in a somewhat different manner. The rear of the body has edges with an underlying binding as described above, but only the portions around the wearer's back have a non-flexible underlying binding followed by a flexible binding abutting on to the non-flexible binding at the approximate level of the underarm of the wearer to allow for more comfort. The device is fastened at the back around the shoulder blades with pieces of fastening fibers. Optionally a blanket can be attached to the body in the region of the upper or lower torso.

DETAILED DESCRIPTION OF THE INVENTION

Figure 1:
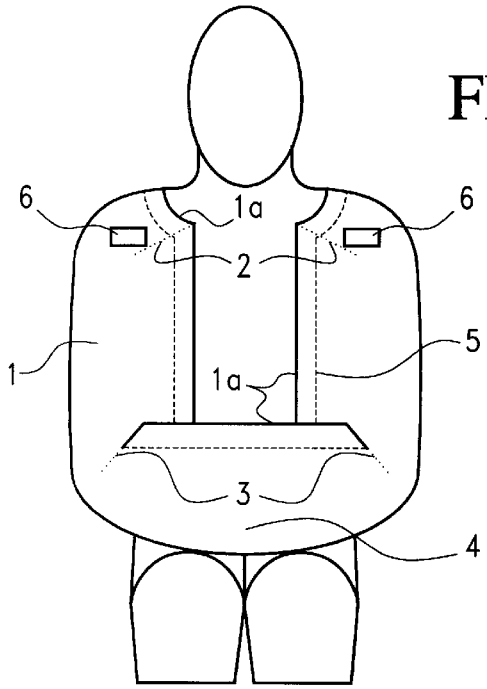
FIG. 1 is a frontal view of the device as worn.
Figure 2:
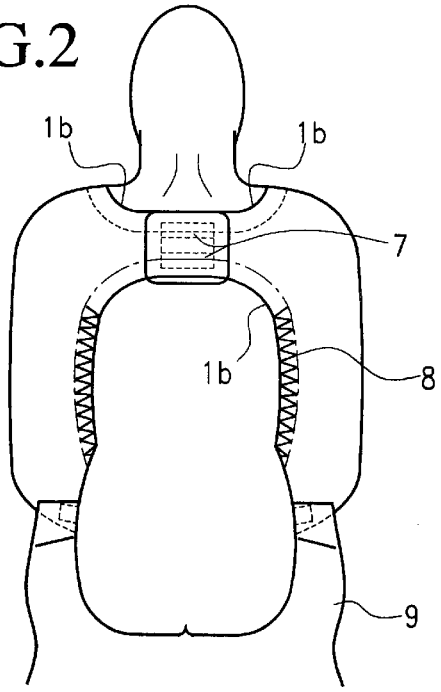
FIG. 2 is a rear view of the device as worn.
Figure 3:
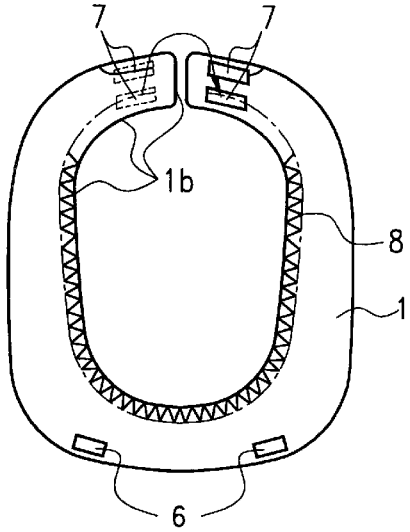
FIG. 3 is a rear view of the device per se.
Figure 4:
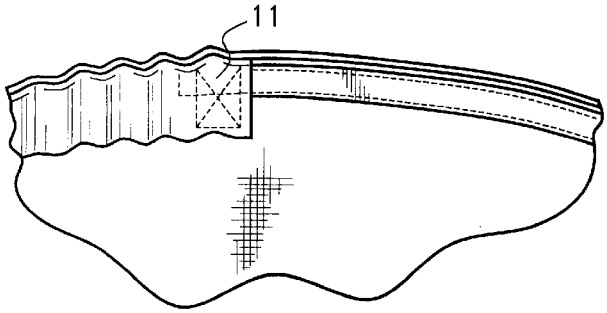
FIG. 4 is a view of the abutment where the elastic binding abuts the rigid non-flexible binding.

FIG. 1 shows the front of an arm support AS having a body 1 with front edges 1*a*. The shape of the front is generally square-like, having darts 2 at the shoulders and darts 3 at the elbows. The upper arms and shoulders are enclosed by the body which continues into a horizontal envelope 4 secured by the aforesaid darts 3, so that when the elbows are bent, the lower portions of the arms and hands rest comfortably within the envelope. The front edges of the body that enclose the arms as well as the front edges of the envelope are bound with thin strips of underlying, rigid, non-flexibie fabric 5 to provide stability to the body. (The strips could also be overlying, but for aesthetic reasons underlying is preferable). The non-flexible binding extends horizontally beyond both the front vertical edges of the body and along the front edges of the horizontal envelope. Adjacent the juncture of the shoulder darts, there are two small press fasteners 6, as for example a product sold under the Trademark "Velcro", for a purpose to be subsequently described. The body is made of flexible, knit fabric material such as nylon, cotton, rayon or a polyester, and could be made in different colors and patterns. The body is constructed of a single piece of fabric which extends from the back of the wearer, over the shoulder, down front and back of one upper arm, across the front and back of the envelope, up the front and back of the other upper arm and around the other shoulder to the upper back again. As shown in FIG. 2, the upper back is the region where rear edges 1*b* of the fabric overlap to close. They are secured by two strips 7 of fiber fasteners such as "Velcro". These strips of are of a length to enable adjustment of the support in accordance with different sizes and shapes of the wearer. The front edges, shoulders and rear edges of the upper back portion are bound with the aforementioned, underlying strips of rigid, non-flexible binding. The ends of the upper back portion are joined to a flexible, elastic binding 8 which butts (at 11) onto the rigid non-flexible binding at a point in alignment with the underarms. This combination of rigid and flexible, elastic binding is more or less elliptical in shape with most of its circumference being of the flexible, elastic type. Unlike the front of the body, there is no envelope. The elastic binding allows for some movement of the support and prevents tightness around the torso. Just below the elbows and on the rear of the body there are placed two additional patches of press fastener. These patches are in alignment with the aforementioned patches in the front of the body and for the same purpose. If desired a blanket 9 can be attached to the patches at the bottom rear and laid over the lap, or the whole body can be covered by attaching a longer blanket to the patches on the top front of the body.

This invention was the direct result of the Inventor's personal experiences. On occasion when the inventor had to take long trips, stress in the arms and shoulders was experienced, due to a tendency to fold the arms. Further because of the monotony of the trip, there was an inclination to fall asleep with the arms in folded condition. Relaxation caused an unbalancing that led to the arms falling to the sides and a sudden awakening which was very disturbing. The result is the invention described above. The invention should be a boon to all those that travel or sit for long periods of time. It is easy to install, that is, it can be worn like a sweater, and the arms can be pulled out through the wide front opening if an emergency presents itself. It provides a sense of comfort and security and the support can keep the arms and shoulders warm.

While the preferred embodiments of this invention have been shown, it should be understood that various modifications and changes that would be obvious to those skilled in the art could be made without departing from the scope of the invention as defined by the appended claims.

I claim:

1. A portable arm support adapted to be worn like a sweater, especially useful for travelers or for persons undergoing medical treatment, who must sit for extended time periods, comprising:

a) a main body divided into a front and rear and enclosing lower arms, elbows, upper arms, shoulders, neck and back, b) said main body made of a flexible, knitted fabric and having darts at said front near the shoulders and elbows, and said front having a shape approximating that of a square, and including a horizontal envelope, c) said horizontal envelope secured across said main body such that when said elbows are bent, said lower arms rest comfortably within said envelope, d) said body having horizontal and vertical edges, said edges being bound on said front by underlying strips of rigid, non-flexible fabric, one of said strips binding said horizontal edges extending past said vertical edges, said body and said strips forming an arc around said shoulder and neck that extends around said rear, said body terminating at said rear into two arcuate portions bound by said strip below said rear of said neck, said arcuate portions devolving into vertical edges, said vertical edges being integral with a lower edge in the shape of an ellipse, said lower rear edge being bound by an underlying non-rigid binding strip that is butted with an underlying, flexible binding strip at the approximate height of said wearer's underarms, said flexible binding occupying a predominant amount of circumference of said ellipse, e) a pair of press fasteners secured on respective under and over surfaces of said arcuate terminating portions, said fasteners securing said arcuate portions together when said portions are overlapped.

2. An arm support as in claim 1 wherein said press fasteners are made of hook and pile material.

3. An arm support as in claim 1 wherein said press fasteners are made of a length to allow adjustment of said arm support in accordance with the size and shape of said wearer.

4. An arm support as in claim 1 wherein said elliptical shaped elastic binding extends circumferentially from near the bottom of said rear of said body to a point below but in alignment with said shoulder, said binding being stitched to said body.

5. An arm support as in claim 2 wherein two spaced patches of hook and pile fasteners are placed on said front of said body in the region of said shoulders, and two lower spaced patches of hook and pile fasteners on said rear of the body, said patches being below said elbows and in alignment with said patches in the region of said shoulder, enabling a blanket to be attached in accordance with a wearer's choice of patch locations such that said blanket covers upper and lower extremities or lower extremities only.

6. An arm support as in claim 1 wherein said knitted fabric is made of a material selected from nylon, cotton, rayon, or polyester.

7. An arm support as in claim 1 wherein said fabric can be made in different colors and designs.

* * * * *